United States Patent [19]

Yogo et al.

[11] Patent Number: 4,708,199

[45] Date of Patent: Nov. 24, 1987

[54] HEAT EXCHANGER

[75] Inventors: Takeji Yogo, Sakado; Akitsuna Nakagaki, Kowagoe; Akio Miyazawa, Kamifukuoka; Takeshi Mitomo, Kitamoto; Takayuki Ichihara, Sayama, all of Japan

[73] Assignee: Kabushiki Kaisha Tsuchiya Seisakusho, Tokyo, Japan

[21] Appl. No.: 834,816

[22] Filed: Feb. 28, 1986

[30] Foreign Application Priority Data

| | | | |
|---|---|---|---|
| Feb. 28, 1985 | [JP] | Japan | 60-28283[U] |
| Mar. 28, 1985 | [JP] | Japan | 60-64619 |
| Jul. 30, 1985 | [JP] | Japan | 60-117012[U] |
| Aug. 31, 1985 | [JP] | Japan | 60-133541[U] |
| Jan. 31, 1986 | [JP] | Japan | 61-13377[U] |

[51] Int. Cl.[4] ..... F28F 3/00

[52] U.S. Cl. ..... 165/167; 165/175

[58] Field of Search ..... 165/173, 175, 166, 167

[56] References Cited

U.S. PATENT DOCUMENTS

| | | | |
|---|---|---|---|
| 1,731,575 | 10/1924 | Hyde | 165/175 |
| 2,322,047 | 3/1942 | Mormile | 257/2 |
| 3,360,038 | 12/1967 | Stampes | 165/166 |
| 3,743,011 | 7/1973 | Frost | 165/167 X |
| 4,162,703 | 7/1979 | Bosaeus | 165/167 |
| 4,193,442 | 3/1980 | Vian | 165/35 |
| 4,360,055 | 11/1982 | Frost | 165/38 |
| 4,561,494 | 12/1985 | Frost | 165/76 |

FOREIGN PATENT DOCUMENTS

| | | | |
|---|---|---|---|
| 58-130009 | 9/1983 | Japan . | |
| 59-108065 | 7/1984 | Japan . | |
| 59-28219 | 8/1984 | Japan . | |
| 59-192610 | 12/1984 | Japan | 165/167 |

*Primary Examiner*—Albert W. Davis, Jr.
*Assistant Examiner*—Peggy Nejls
*Attorney, Agent, or Firm*—Schwartz, Jeffery, Schwaab, Mack, Blumenthal & Evans

[57] ABSTRACT

A heat exchange element of a plate type heat exchanger consists of a plurality of heat transmission plates having an equivalent shape. Each heat transmission plate is formed with flanged through-holes and openings so that each flanged through-hole and each opening are alternately located and separate from each other by a predetermined peripheral distance along a circle of the heat transmission plate. The heat transmission plates are disposed one upon another and sealingly secured to each other in such a manner that one of adjacent heat transmission plates is shifted the predetermined peripheral distance along the circle relative to the other heat transmission plate, thereby enabling to produce the heat exchanger heat exchange element by using only the heat transmission plates of the equivalent shape.

24 Claims, 32 Drawing Figures

HEAT EXCHANGER

BACKGROUND OF THE INVENTION

1. Field of the Invention

The present invention relates generally to a plate type heat exchanger for two different fluids, and more particularly to a so-called housing-less automotive heat exchanger usable in combination with an oil filer.

2. Description of the Prior Art

In connection with automotive plate type heat exchanger used for cooling engine lubricating oil, a so-called housing-less heat exchanger has been already proposed in which a plurality of heat exchange units are piled up and secured to each other in such a manner that a lubricating oil flowing space and a cooling water flowing space are alternately formed, thus forming a heat exchange element. Each heat exchange unit is constructed of upper and lower heat transmission plates of different shapes, so that the lubricating oil flowing space and the cooling water flowing space are defined on the opposite sides of each of upper and lower heat transmission plates. Accordingly, heat exchange between the lubricating oil and the cooling water is accomplished through each of the upper and lower heat heat transmission plates.

However, difficulties have been encounted in such a conventional housing-less heat exchanger because each heat exchange unit is constructed of two kinds of heat transmission plates of the difference shapes. That is to say, two kinds of heat transmission plates are unavoidably required to form the heat exchange element and therefore the productivity of the heat exchanger is lower while increasing the production cost thereof. Additionally, the two heat transmission plates of the different shapes are relatively difficult to tightly and sealingly fit each other, thus causing possibility of leaking of the lubricating oil and/or the cooling water.

SUMMARY OF THE INVENTION

A housing-less heat exchanger according to the present invention comprises a heat exchange element consisting of a plurality of heat transmission plates which have an equivalent shape and are disposed one upon another to contact each other. Each heat transmission plate includes a flat section through which heat exchanger is accomplished between two fluids. A plurality of annular flanges are formed protruding from the flat section, each annular flange defining a through-hole opened through the flat section. A plurality of openings are formed opened through the flat section. At least one of the through-hole and at least one of openings alternately located along a circle on the heat transmission flat section. Additionally, the axes of adjacent through-hole and opening are spaced from each other by a predetermined peripheral distance along the circle. The heat transmission plates are so located that one of adjacent two heat transmission plates is peripherally shifted said predetermined distance along the circle relative to the other heat transmission plate, in which the annular flange defining the through-hole of the former heat transmission plate contacts with the latter heat transmission plate so that the former heat transmission plate through-hole communicates with the latter heat transmission heat transmission plate opening. The heat transmission plates are sealingly connected with each other to define two fluid flowing spaces, respectively, for the two fluids on the opposite sides of each heat transmission plate.

Thus, the heat exchange element of the heat exchanger is constructed of heat transmission plates of the equivalent shape and therefore the productivity of the heat exchanger is higher, lowering the production cost thereof. Furthermore, the equivalent shape heat transmission plates are excellent to sealingly fit to each other, thus preventing leaking of the fluids.

BRIEF DESCRIPTION OF THE DRAWINGS

The features and advantages of the heat exchanger according to the present ivnention will be more clearly appreciated from the following description taken in conjunction with the accompanying drawings in which like reference numerals designate like elements and parts throughout the drawings, in which.

DETAILED DESCRIPTION OF THE INVENTION

Figure 1:
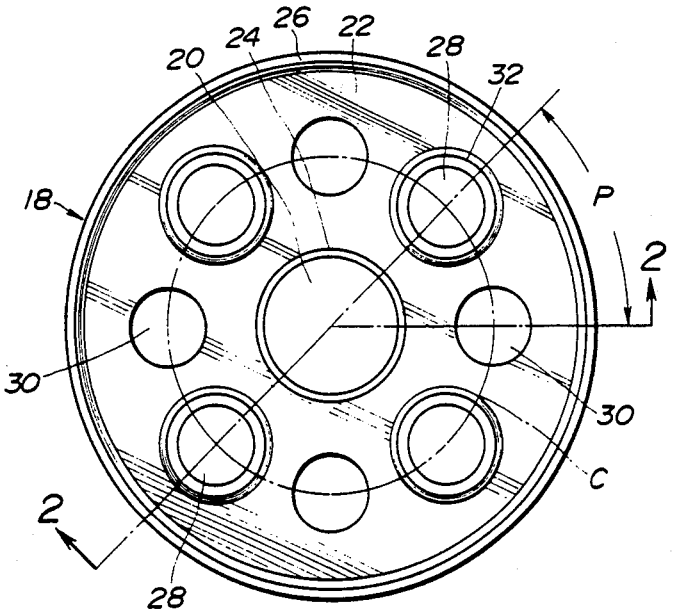
FIG. 1 is a plan view of a heat transmission plate forming part of an heat exchange element of a first embodiment heat exchanger in accordance with the present invention.

Referring now to FIGS. 1 to 4, there is shown a first embodiment of a plate type heat exchanger or oil cooler 10 in accordance with the present invention. The heat exchanger 10 in this embodiment is used for an internal combustion engine for the purpose of cooling engine lubricating oil with engine coolant such as engine cooling water. The heat exchanger 10 is usually mounted at its bottom section on an engine block 12 so that lubricating oil to be cooled is introduced into the heat exchanger 10. In this instance, the heat exchanger 10 is used in combination with an oil filter 14. The oil filter 14 is mounted on the top section of the heat exchanger 10 so that the cooled lubricating oil is supplied from the heat exchanger 10 to the oil filter 14 so as to filter the lubricating oil. The thus filtered lubricating oil is fed back through a hollow center bolt or tube 16 to the engine block 12.

Figure 2:
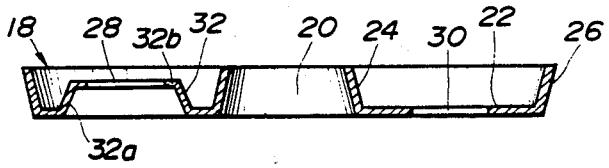
FIG. 2 is a sectional view taken in the direction of arrows substantially along the line 2—2 of FIG. 1.
Figure 3:
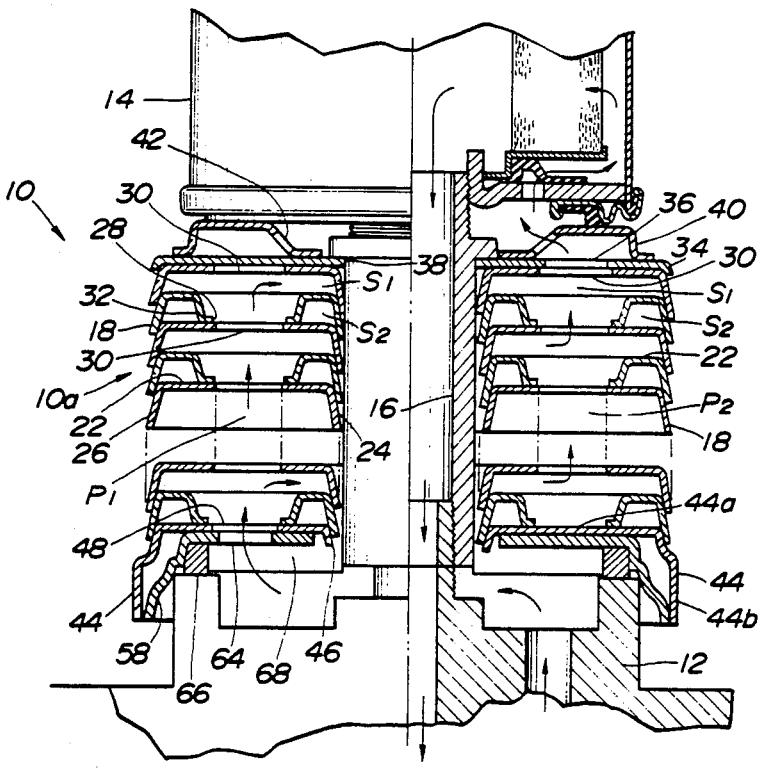
FIG. 3 is a vertical sectional view of the first embodiment heat exchanger, taken along a vertical plane.

The heat exchanger 10 comprises a heat exchange element 10*a* consisting of a plurality of heat transmission plates 18 which are made of a metal and piled up as shown in FIG. 3 in which the adjacent heat transmission plates are secured to each other, for example, by means of brazing. Each heat transmission plate 18 is generally annular with a central hole 20 as shown in FIG. 1. The heat transmission plate 18 includes annular flat section 22 having inner and outer periphery. An annular inner flange 24 is integrally connected at its one end with the flat section 22 at the inner periphery. The inner flange 24 is short and generally cylindrical so that the inner diameter thereof decreases in the direction far from the inner periphery of the flat section 22. In other words, the inner flange 24 has the frustoconical inner and outer surfaces. An annular outer flange 26 is integrally connected at its one end with the flange section at the outer periphery. The outer flange 24 is short and generally cylindrical so that the inner diameter thereof increases in the direction far from the outer periphery of the flat section 22. In other words, the outer flange 26 has the frustoconical inner and outer surfaces. The inner and outer flanges 24, 26 are the same in length or height as shown in FIG. 2.

In this embodiment, the heat transmission plate 18 is formed at the flat section 22 with a plurality (four) of circular through-holes 28 and a plurality (four) of circular openings 30 which are aligned circularly in such a manner that the center of each of the through-hole 28 and each opening 30 resides in an imaginary circle C concentrical with the inner and outer peripheries of the heat transmission plate 18 as viewed from the direction of the axis of the heat transmission plate 18 or in FIG. 1. More specifically, the axis (not identified) of each of the through-hole 28 and the opening 30 crosses the imaginary circle C. As shown in FIG. 2, each through-hole 28 is defined by an annular flange 32 projected from the flat section 22 in the same direction as the inner and outer flanges 24, 26. The annular flange 32 includes a generally cylindrical portion 32*a* with inner and outer frustoconical surfaces. An annular flat portion 32*b* is integral with the cylindrical portion 32*a* at the free end, defining the through-hole 28. The annular flange 32 is smaller in height or axial length than the inner or outer flange 24, 26. The opening 30 is formed through the flat section 22 of the heat transmission plate 18 with no flange.

As illustrated in FIG. 1, each of the through-holes 28 and each of the openings 3 are located alternately along the imaginary circle C so that each through-hole 28 is located between the two openings 30, 30 while each opening 30 is located between the two through-holes 28, 28. Additionally, the through-holes 28 and the openings 30 are positioned at equal intervals along the circle C in such a manner that a pitch P of peripheral angle of 45 degrees between the axes of the adjacent through-holes 28 and the opening 30 is equivalent. The pitch P corresonds to a peripheral distance (on the circle C) between the axes of the adjacent through hole 28 and opening 30. In this connection, the axes of the adjacent through-holes 28, 28 are located to form a pitch of an angle of 90 degrees, and the axes of the adjacent openings 30, 30 are located to form a pitch of an angle of 90 degrees.

Figure 4:
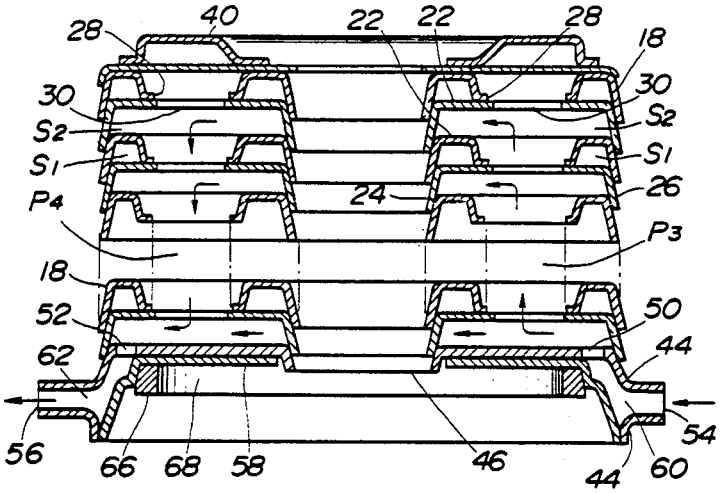
FIG. 4 is a vertical sectional view similar to FIG. 3 but taken along the other vertical plate.

As illustrated in FIGS. 3 and 4, the heat transmission plates 18 of the above-mentioned type are piled up in such a fashion that each transmission plate 18 shown in FIG. 2 is located upside down. Additionally, the adjacent upper and lower heat transmission plates 18, 18 contacted each other are located shifted the pitch P of the peripheral angle of 45 degrees, so that the axis of each through-hole 28 and the axis of each opening 30 of the upper heat transmission plate 18 are coincident with the axis of each opening 30 and the axis of each through-hole 28 of the lower heat transmission plate 18, respectively. The adjacent heat transmission plates 18, 18 are securely connected with each other, for example, by means of brazing, securing fluid-tight seal therebetween. As shown, the inner frustoconical surface of the outer flange 26 of the upper heat transmission plate 18 contacts or connects with the outer frustoconical surface of the outer flange 26 of the lower heat transmission plate 18. The outer frustoconical surface of the inner flange 24 of the upper heat transmission plate 18 contacts or connects with the inner frustoconical surface of the inner flange 24 of the lower heat transmission plate 18. Furthermore, the annular flange 32 defining the through-hole 28 of the upper heat transmission plate 18 contacts or connects at its annular flat portion **32*b* with the flat portion 22 of the lower heat transmission plate 18 in such a manner that the annular flat portion 32*b* of the upper heat transmission plate 18 is located around the opening 30 of the lower heat transmission plate 18. It will be understood that the thus formed contacted or connected sections of the adjacent upper and lower heat transmission plates 18, 18** are rigidly and sealingly secured to each other, for example, by means of brazing.

Thus, by virtue of the annular flanges 32, first and second fluid flowing spaces $S_1$, $S_2$ are alternately formed and completely separate from each other. In this embodiment, engine lubricating oil flows in the first fluid flowing spaces $S_1$ while engine cooling water flows in the second fluid flowing spaces $S_2$. In addition, a vertically aligned row of the through-holes 28 and the openings 30 forms a vertical fluid passage, thereby forming eight vertical fluid passages as a whole. Of these vertical fluid passages, the first and second vertical fluid passages forms a first group of vertical fluid passages $P_1$, the third and fourth vertical fluid passages a second group of vertical fluid passages $P_2$, the fifth and sixth vertical fluid passages third group of vertical fluid passage $P_3$, and the seventh and fifth vertical fluid passages a fourth group of vertical fluid passages $P_4$. Accordingly, the first group of the vertical fluid passages $P_1$ include the two openings 30 of the upper-most heat transmission plate 18 and the two through-holes 28 of the lower-most heat transmission plate 18 as shown in FIG. 3. Similarly, the second group of vertical fluid passages $P_2$ include the other two openings 30 of the upper-most heat transmission plate 18 and the other two through-holes 28 of the lower-most heat transmission plate 18. The third groups of the vertical fluid passages $P_3$ include the two through-holes 28 of the upper-most heat transmission plate 18 and the two openings 30 of the lower-most heat transmission plate 18 as shown in FIG. 4. Similarly, the fourth group of the vertical fluid passages $P_4$ include the other two through-holes 28 of the upper-most heat transmission plate 18 and the other two openings 30 of the lower-most heat transmission plate 18. It will be appreciated that the engine lubricating oil flows through the first and second groups of vertical fluid passages $P_1$, $P_2$, while the engine cooling water flows through the third and fourth groups of vertical fluid passages $P_3$, $P_4$.

An annular upper closure plate 34 is secured onto the upper-most heat transmission flat section 22, for example, by means of brazing and formed with openings 36, 36 communicated with the second groups of vertical fluid passages $P_2$. More specifically, the openings 36, 36 are coincident with the two openings 30, 30 (of the upper-most heat transmission plate 18) forming part of the second groups of vertical fluid passages $P_2$. The other two openings 30 and all the four through-holes 28 (of the upper-most heat transmission plate 18) forming part of the first, third and fourth groups of vertical fluid passages $P_1$, $P_2$ and $P_4$ are closed with the upper closure plate 34 formed with a central opening 38. An annular top cover 40 is secured on the upper closure plate 34, for example, by means of brazing and defines thereinside an oil outlet chamber (no numeral) communicated with the second group of vertical fluid passages $P_2$. The annular top cover 40 is formed with an oil outlet opening 42.

An annular lower closure plate 44 is secured to the lower-most heat transmission plate 18, for example, by means of brazing. The lower closure plate 44 is formed with a central hole 46 and includes an annular flat section **44*a* to which the annular flanges 32 is secured. The annular flat section 44*a* is formed with openings 48, 48 coincident with the respective through-holes 28, 28 (of the lower-most heat transmission plate 18) forming part of the first group of the vertical fluid passages $P_1$. The annular section 44*a* is further formed with water inlet and outlet openings 50, 52 as shown in FIG. 4. The water inlet opening 50 is communicated with the openings 30 (of the lower-most heat transmission plate 18) forming part of the third group of vertical fluid passage $P_3$. The water outlet opening 52 is communicated with the openings 30 (of the lower-most heat transmission plate 18) forming part of the fourth group of vertical fluid passages $P_4$. The lower closure plate 44 further includes a generally cylindrical section 44*b* which is formed with water inlet and outlet pipes 54, 56 as shown in FIG. 4. An annular bottom cover 58 is secured to the lower closure plate 44, for example, by means of brazing, so that a water inlet chamber 60 and a water outlet chamber 62 are defined between the annular lower closure plate 44 and the bottom cover 58. It will be understood that the water inlet and outlet chambers 60, 62 are separate from each other. The inside of the water inlet pipe 54 is communicated through the water inlet chamber 60 with the water inlet opening 50. The inside of the water outlet pipe 56 is communicated through the water outlet chamber 62 with the water outlet opening 52. The bottom cover 58 is formed with openings 64, 64 coincident with the respective openings 48, 48 of the lower closure plate 44 and the through-holes 28, 28 of the lower-most heat transmission plate 18, which through-holes form part of the first group of vertical fluid passages $P_1$. An annular gasket 66 is fixedly disposed inside the bottom cover to define thereinside an oil inlet chambe 68 communicated with the first group of vertical fluid passages $P_1$ through the openings 64, 48. It will be understood that the heat exchanger 10 is securely mounted through the gasket 66 on the engine block 12**.

The manner of operation of the thus arranged heat exchanger 10 will be discussed hereinafter.

The engine lubricating oil from an oil pan of the engine block 12 is supplied to the oil inlet chamber 68 and then introduced through the openings 64, 48 into the first group of vertical fluid passages $P_1$ of the heat exchanger 10. The lubricating oil flows upwardly through the first group of vertical fluid passages $P_1$ and simultaneously flows through the horizontally extending fluid flowing spaces $S_1$ and reaches the second group of vertical fluid passages $P_2$. Thereafter, the lubricating oil flows out of the heat exchanger 10 through the openings 30, 36 and the oil outlet opening 42. The lubricating oil discharged from the heat exchanger 10 is then introduced into the oil filter 14 to be filtered. The thus filtered lubricating oil discharged from the filter 10 is fed back to the engine block 12 through the the inside hollow of the center bolt 16. During such lubricating oil flow in the above-mentioned manner, the engine cooling water enters the water inlet chamber 60 through the water inlet pipe 54 and thereafter introduced through the water inlet opening 50 into the third group of vertical fluid passages $P_3$. The cooling water flows upward through the vertical fluid passages $P_3$ and simultaneously the cooling water flows through the horizontally extending fluid flowing spaces $S_2$ located between the above-mentioned fluid flowing spaces $S_1$ for the lubricating oil. The thus flowing cooling water reaches the fourth group of vertical fluid passages $P_4$ and flows downward to be introduced into the water outlet chamber 62 through the wate outlet opening 52. Thereafter, the cooling water is fed out of the heat exchanger 10. It is to be noted that heat exchange between the lubricating oil and the cooling water is carried out through the wall of the annular flanges 32 defining the through-holes 28 in additio to through the wall of the flat sections 22 of the heat transmission plates 18.

Accordingly, the heat exchange element of the heat exchanger of this embodiment is constructed of the heat transmission plates of the equivalent shape, and therefore production of the heat exchanger is facilitated to improve the productivity of the same while lowering the production cost of the heat exchanger. Furthermore, the equivalent shape heat transmission plates are excellent in fitness to each other thereby to maintain tight seal therebetween, thus preventing the leaking of the lubricating oil and/or the cooling water. Since heat exchange between the lubricating oil and the cooling water is accomplished also through the wall of the annular flanges 32 of each heat transmission plate in addition to through the flat section 22 of the same, the area of heat exchange becomes larger. Additionally, the annular flanges 32 serve as support columns between the adjacent upper and lower heat transmission plates, and consequently no reinforcement members are necessary between the adjacent heat transmission plates. Moreover, by suitably selecting the location or the number of the through-holes 28 and the openings 30, it is possible, for example, to produce turbulent flow of the lubricating oil and the cooling water and to allow the lubricating oil and the cooling water to flow in the directions of counterflow, thereby improving heat exchange efficiency of the heat exchanger.

Figure 5:
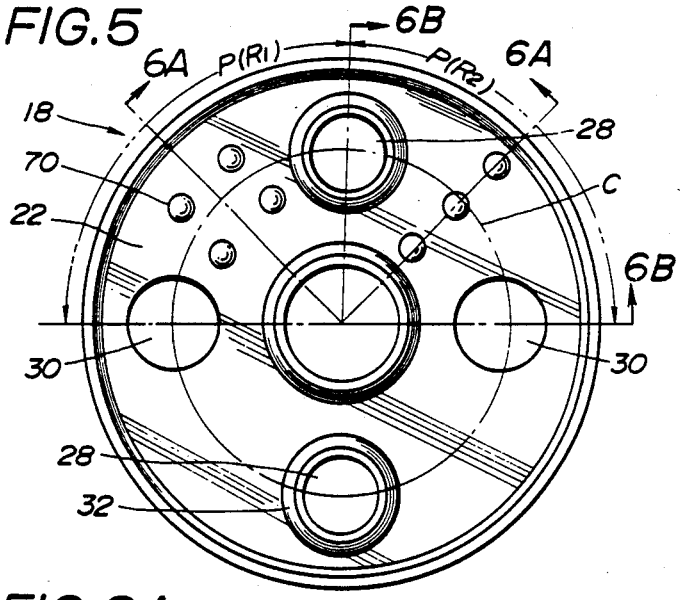
FIG. 5 is a plan view of a heat transmission plate forming part of a heat exchange element of a second embodiment of the heat exchanger according to the present invention.
Figure 6A:
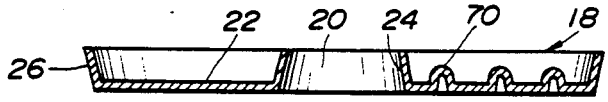
FIG. 6A is a sectional view taken in the direction of arrows substantially along the line 6A—6A of FIG. 5.
Figure 6B:
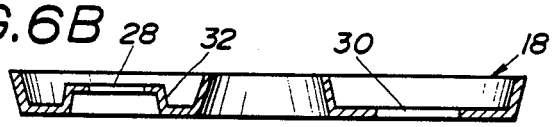
FIG. 6B is a sectional view taken in the direction of arrows substantially along the line 6B—6B of FIG. 5.

FIGS. 5, 6A and 6B illustrate a second embodiment of the heat exchanger in accordance with the present invention, which is similar to the first embodiment heat exchanger mainly with the exception that each heat transmission plate 18 is formed with two openings 30 and two through-holes 28. In this embodiment, the adjacent opening 30 and through-hole 28 are located with a pitch P of an angle of 90 degrees. More specifically, the axes of the adjacent opening 30 and the through-hole 28 are separate from each other a peripheral distance corresponding to the pitch P on the circle C. It will be understood that the heat exchanger of this embodiment is provided with the first vertical fluid passage $P_1$ including the opening 30, the second vertical fluid passage $P_2$ including the other opening 30, the third vertical fluid passage $P_3$ including one through-hole 28, and the fourth vertical fluid passage including the other through-hole 28, though not shown. Accordingly, the first, second, third and fourth vertical fluid passages correspond to the first, second, third, and fourth groups of vertical fluid passages $P_1$, $P_2$, $P_3$ and $P_4$, respectively.

In order to assemble the heat exchanger by using a plurality of heat transmission plates of the above-mentioned type, the upper heat transmission plate 18 is shifted the angle of 90 degrees relative to the lower transmission plate 18 of the adjacent two heat transmission plates so that each through-hole 28 and each opening 30 of the upper heat transmission plate 18 are brought to be coincident with each opening 30 and each through-hole 28, respectively.

Additionally, each heat transmission plate 18 of this embodiment is formed throughout its flat section 22 with a plurality of projections each of which protrudes in the same direction as the annular flange 32 and as the inner and outer flanges 24, 26. It is to be noted that the arrangements of the projections 70 are different between within ranges $R_1$, $R_2$ as shown in FIG. 5. The ranges $R_1$ and $R_2$ correspond to the respective ranges defined by the two pitchs P of the adjacent opening 30 and the through-hole 28. Accordingly, the projections 70 of the adjacent heat transmission plates are prevented from being coincident with each other, in which the projections 70 are brought into contact with the surface of the heat transmission plate flat section 22 when the heat transmission plates 18 are piled up upon peripherally shifting the adjacent heat transmission plates 18 from each other by the pitch P. It will be understood that the projections 70 increases the heat transmission area of each heat transmission plate 18, while serving as reinforcement members for maintaining the spaced relationship between the adjacent heat transmission plates.

Figure 7:
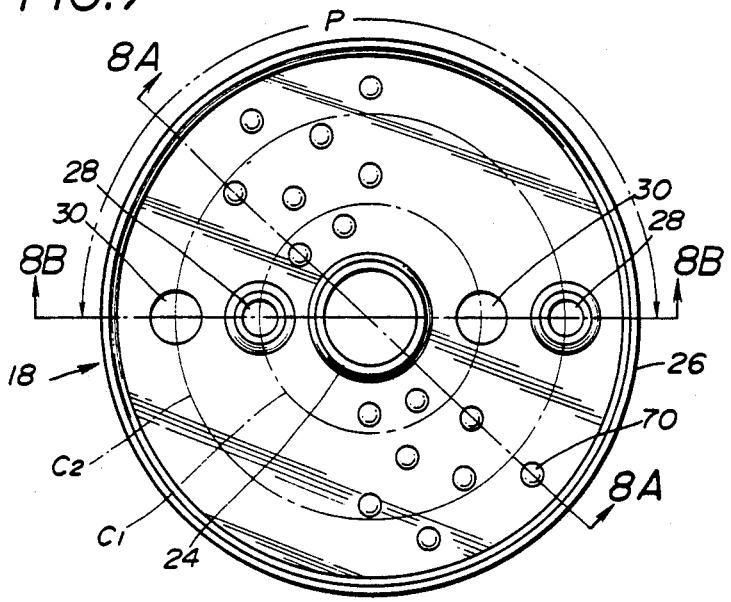
FIG. 7 is a plan view of a heat transmission plate forming part of a heat exchange element of a third embodiment of the heat exchanger according to the present invention.
Figure 8A:
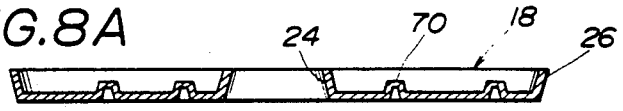
FIG. 8A is a sectional view taken in the direction of arrows substantially along the line 8A—8A of FIG. 7.
Figure 8B:
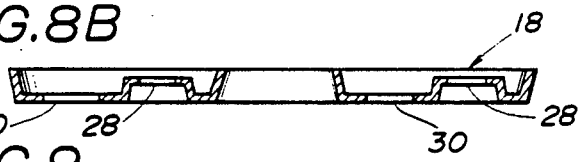
FIG. 8B is a sectional view taken in the direction of arrows substantially along the line 8B—8B of FIG. 7.
Figure 9:
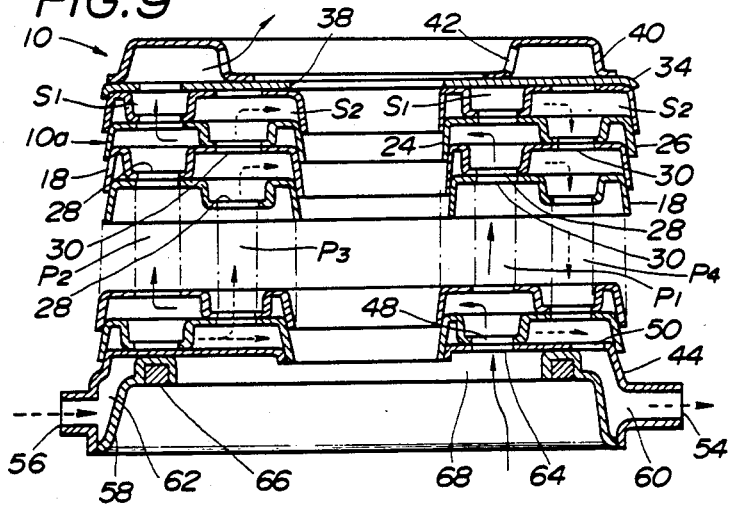
FIG. 9 is vertical sectional view of the third embodiment heat exchanger.

FIGS. 7, 8A, 8B and 9 illustrate a third embodiment of the heat exchanger in accordance with the present invention, which is similar to the second embodiment heat exchanger 10 except mainly for the location of the two openings 30 and the two through-holes 28. In this embodiment, one through-hole 28 and one opening 30 have their axes lying on an inner circle $C_1$, and the other through-hole 28 and the other opening 30 have their axes lying on an outer circle $C_2$. The inner and outer circles $C_1$, $C_2$ are coaxial with each other and with central hole 20 of the heat transmission plate 18. The through-hole 28 and the opening 30 are located separate with the pitch P of an angle of 180 degrees. The through-holes 28 and the openings 30 are alternately aligned along an imaginary vertical plane (not identified) containing the diameter of the heat transmission plate flat section 22 as shown in FIG. 7. Accordingly, the heat exchanger 10 of the type shown in FIG. 9 is obtained by piling up the heat transmission plates 18 upon peripherally shifting the adjacent heat transmission plates from each other by the pitch of an angle of 180 degrees. Also in this embodiment, the projections 70 are formed within such ranges that the projections 70 of the adjacent heat transmission plates 18, 18 are prevented from being coincident with each other. With the thus configurated heat exchanger, the lubricating oil flows as indicated by solid arrows while the cooling water flows as indicated by broken arrows in FIG. 9.

Figure 10:
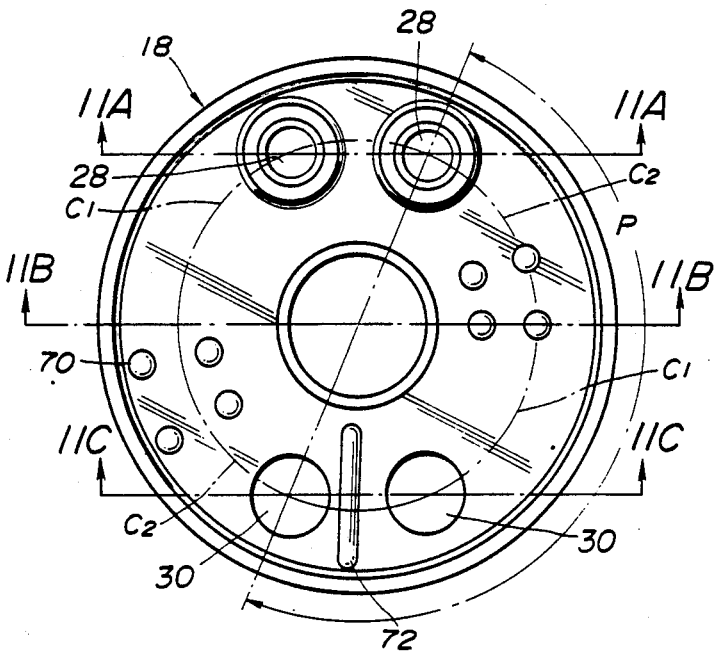
FIG. 10 is a plan view of a heat transmission plate forming part of a heat exchange element of a fourth embodiment of the heat exchanger according to the present invention.
Figure 11A:
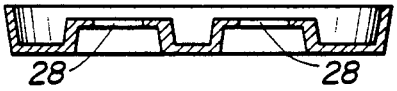
FIG. 11A is a sectional view taken in the direction of arrows substantially along the line 11A—11A of FIG. 10.
Figure 11B:
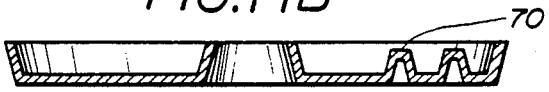
FIG. 11B is a sectional view taken in the direction of arrows substantially along the line 11B—11B of FIG. 10.
Figure 11C:
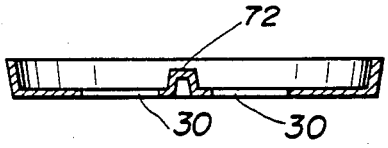
FIG. 11C is a sectional view taken in the direction of arrows substantially along the line 11C—11C of FIG. 10.

FIGS. 10, 11A, 11B and 11C illustrate a fourth embodiment of the heat exchanger according to the present invention, similar to the third embodiment heat exchanger. In this embodiment, one through-hole 28 and one opening 30 have their axis lying on the circle $C_1$, while the other through-hole 28 and the other opening 30 have their axis lying on the circle $C_2$. The circles $C_1$, $C_2$ are coaxial with each other and with the periphery of the heat transmission plate 18. As shown in FIG. 10, the two through-holes 28, 28 are located close to each other and positioned at a half of the flat section 22, and the two openings 30, 30 are located close to each other and positioned at the remaining half of the flat section 22. Also in this embodiment, each heat transmission plate 18 is formed with the porojections 70 located similarly to the third embodiment heat exchanger 10.

In this embodiment, each heat transmission plate 18 is formed with a straight elongate projection 72 which is located between the openings 30, 30 and extends along the imaginary vertical plane containing the diameter of the heat transmission plate flat section 22. Bi virtue of this elongate projection 72, the lubricating oil or the cooling water is prevented from directly flowing from one opening 30 to the other opening 30 along a short cut and therefore the lubricating oil or the cooling water can flow circularly along the periphery of the heat transmission plate 18 from the one opening 30 to the other opening 30. As a result, whole the heat transmission plate flat section 22 is used for heat transmission between the lubricating oil and the cooling water. Additionally, in the heat exchanger configurated by piling up the above-mentioned heat transmission plates 18 upon peripherally shifting by the pitch of an angle of 180 degrees, the elongate projections 72 are brought into opposite locations in the adjacent two fluid flowing spaces $S_1$, $S_2$ for the lubricating oil and the cooling water, so that the lubricating oil and the cooling water takes the form of counterflow. This improves the heat exchanging efficiency between the lubricating oil and the cooling water. It will be appreciated that the circles $C_1$, $C_2$ may have very similar diameters, respectively, or an equivalent diameter.

Figure 12:
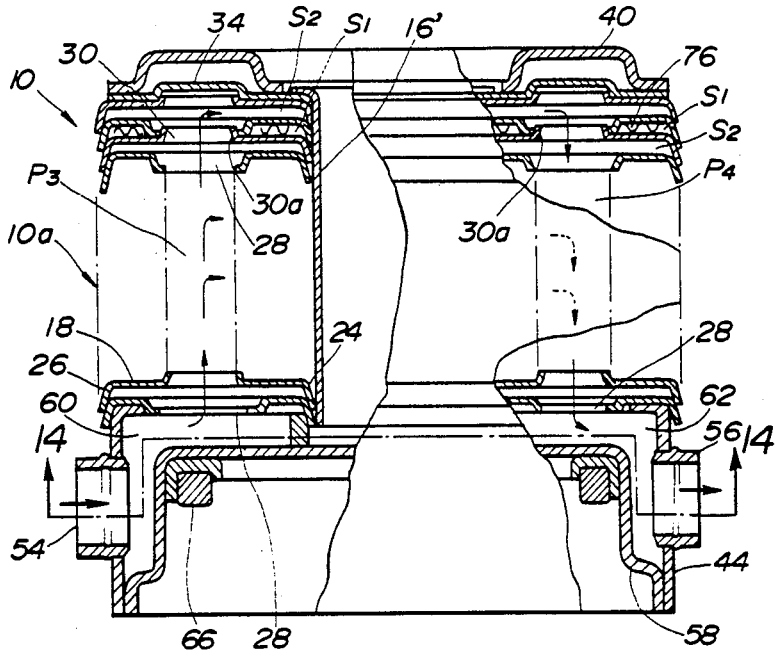
FIG. 12 is a vertical sectional view of a fifth embodiment of the heat exchanger according to the present invention, taken along a vertical plane.
Figure 13:
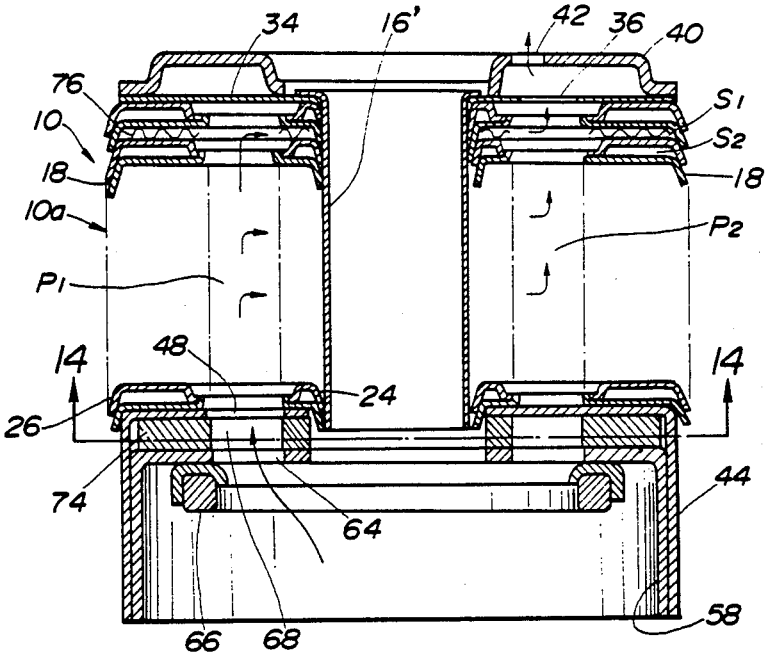
FIG. 13 is a vertical sectional view similar to FIG. 12 but taken along the other vertical plane.
Figure 14:
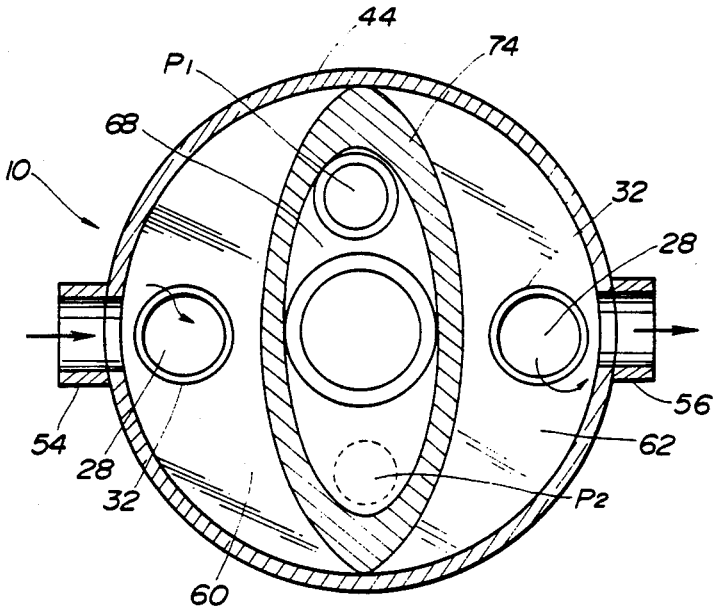
FIG. 14 is a transverse sectional view taken in the direction of arrows substantially along the line 14—14 of FIGS. 12 and 13.
Figure 15:
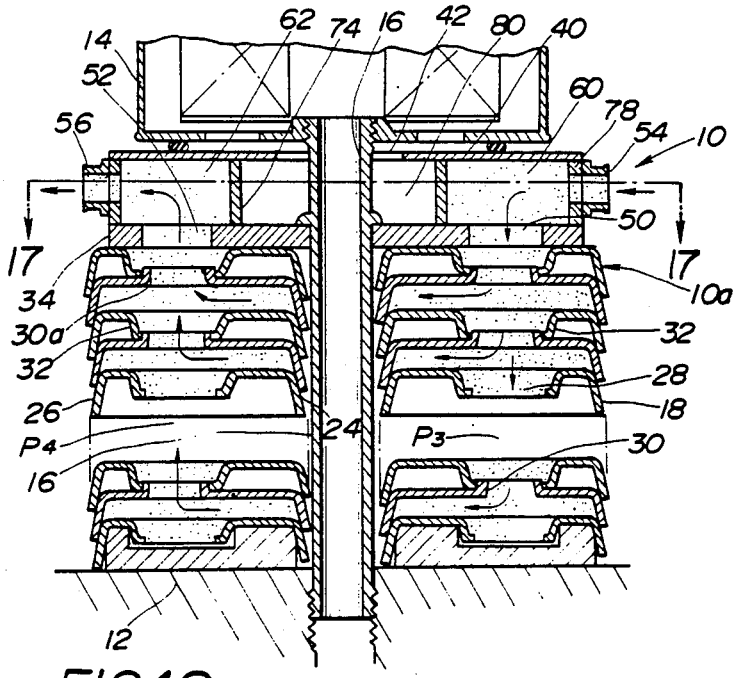
FIG. 15 is a vertical sectional view of a sixth embodiment of the heat exchanger according to the present invention, taken along a vertical plane.
Figure 16:
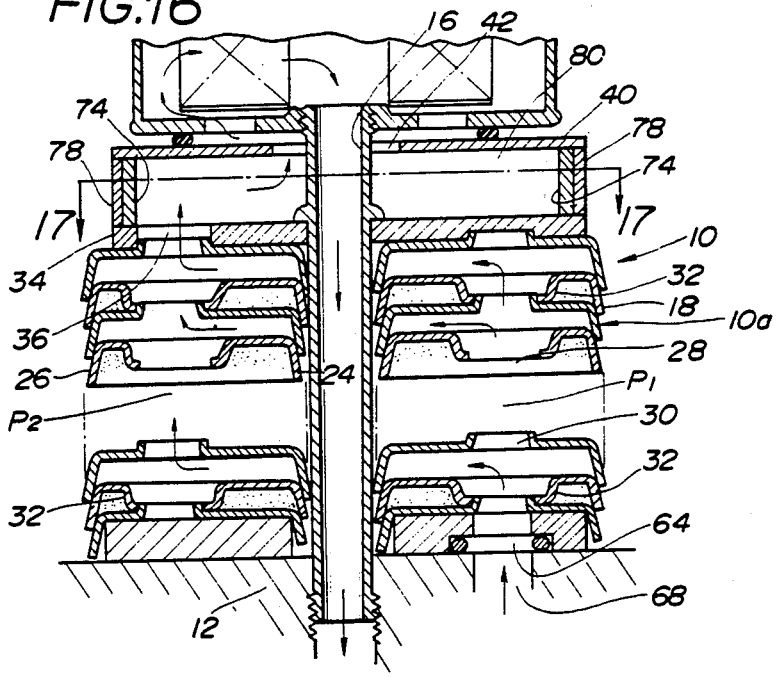
FIG. 16 is a vertical sectional view of the sixth embodiment heat exchanger, similar to FIG. 15 but taken along the other vertical plane.
Figure 17:
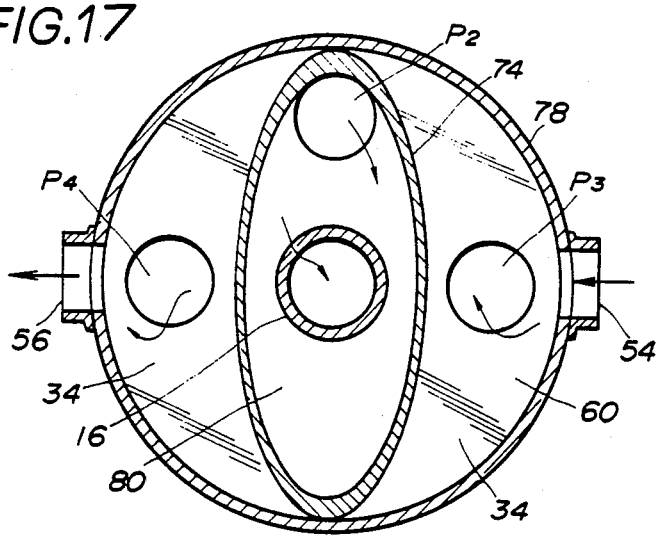
FIG. 17 is a sectional view taken in the direction substantially along the line 17—17 of FIGS. 15 and 16.
Figure 18A:
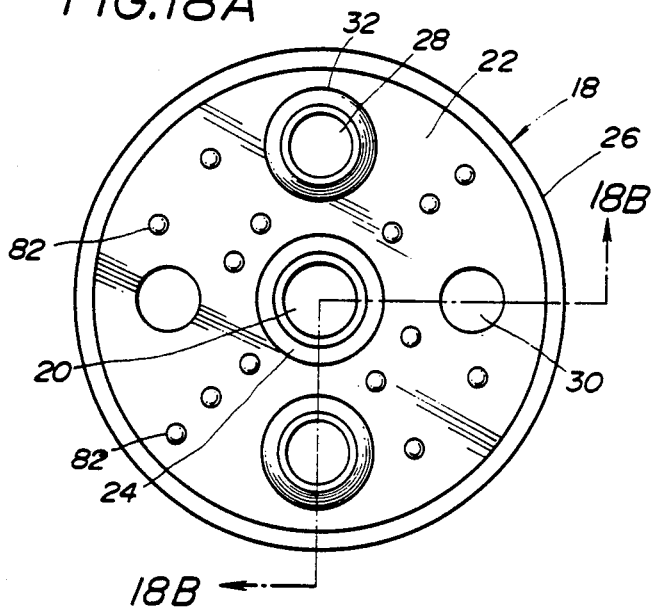
FIG. 18A is a plan view of a heat transmission plate forming part of a heat exchange element of the sixth embodiment heat exchanger.
Figure 18B:
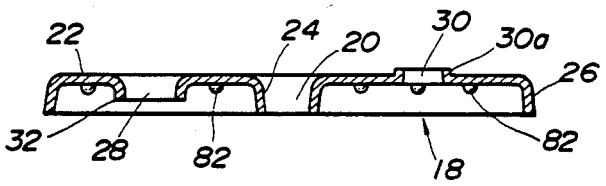
FIG. 18B is a sectional view taken in the direction of arrows substantially along the line 18B—18B of FIG. 18A.

FIGS. 12, 13 and 14 illustrate a fifth embodiment of the heat exchanger according to the present invention, which is similar to the second embodiment heat exchanger. In this embodiment, each opening 30 of each heat transmission plate 18 is defined by an annular short flange 30*a* which is smaller in height or axial length than the annular flange 32. As shown in FIG. 12, the annular short flange 30*a* is engaged at its outer peripheral surface with the inner periphery of the annular flat portion 32*b* of the annular flange 32 defining the through-hole 28. The heat exchanger 10 of this embodiment is provided with a center pipe 16' which is secured to the inner periphery of each heat transmission plate 18, for example, by means of brazing.

In this embodiment, an elliptical and cylindrical wall member 74 is fixedly disposed between the lower closure plate 44 and the bottom cover 58 in such a manner that the opposite ends of the wall member 74 sealingly contact the inner surface of the lower closure plate 44 to define thereinside the oil inlet chamber 68 and thereoutside the water inlet and outlet chambers 60, 62. The oil inlet chamber 68, the water inlet chamber 60 and the water outlet chamber 62 are in communication with the first, third, and fourth vertical fluid passages $P_1$, $P_3$, $P_4$, respectively as illustrated in FIG. 14. As shown in FIGS. 12 and 13, a turbulizer or fin 76 is provided in the horizontally extending first fluid flowing space $S_1$ for the lubricating oil, formed between the adjacent heat transmission plates 18, 18. The turbulizer 76 is secured to the opposite surfaces of the adjacent heat transmission plates 18, 18.

FIGS. 15, 16, 17, 18A, and 18B illustrate a sixth embodiment of the heat exchanger in accordance with the present invention, which is similar to the fifth embodiment heat exchanger mainly with the exception that the water inlet and outlet chambers 60, 62 are formed between the upper closure plate 34 and the annular flat top cover 40'. In this embodiment, an annular outer wall member 78 is securely disposed between the upper closure plate 34 and the top cover 40 so that the water inlet and outlet pipes 54, 56 are provided to the outer wall member 78. Additionally, the elliptical and cylindrical wall member 74 is fixedly and sealingly disposed between the upper closure plate 34 and the top cover 40 in such a manner that the opposite end portions of the wall member 74 sealingly contact the inner peripheral surface of the outer wall member 78. Accordingly, the wall member 74 defines thereinside an oil outlet chamber 80 and thereoutside the water inlet and outlet chambers 60, 62. The oil outlet chamber 80 is communicated with the second vertical fluid passage $P_2$ and with the inside of the oil filter 14. The water inlet chamber 60 is communicated with the third vertical fluid passage $P_3$. The water inlet and outlet chambers 60, 62 are communicated with the third and fourth vertical fluid passages $P_3$, $P_4$, respectively. Each heat transmission plate 18 is formed at its flat section 22 with small projections 82 protruding in the same direction as the annular flange 32 and the inner and outer flanges 24, 26. The small projections 82 serves as reinforcing means for increasing the support strength between the adjacent heat transmission plates 18, 18 and as turbulizing means for improving heat exchange efficiency between the lubricating oil and the cooling water.

While the cylindrical wall member 74 has been shown and described as being elliptical in cross-section in the fifth and sixth embodiments, it will be understood the cylindrical wall member 74 may have other suitable cross-sections. Additionally, the outer wall member 78 in the sixth embodiment may not be cylindrical and therefore otherwise formed.

FIGS. 19, 20A, 20B and 21 illustrate a seventh embodiment of the heat exchanger in accordance with the present invention, which is similar to the second embodiment heat exchanger mainly with the exception that the heat transmission plates 18 are piled up to assemble the heat exchanger in which each heat transmission plate 18 is located upside down as compared with in the second embodiment heat exchanger. Accordingly, in this embodiment, the adjacent heat transmission plates 18 are so united with each other that the inner frustoconical surface of the inner flange 24 of the upper heat transmission plate 18 contacts or engages the outer frustoconical surface of the inner flange 24 of the lower heat transmission plate 18, and the outer frustoconical surface of the outer flange 26 of the upper heat transmission plate 18 contacts or engages the inner frustoconical surface of the outer flange 26 of the lower heat transmission plate 18. The annular flange 32, defining the opening 28, of the lower heat transmission plate 18 contacts or engages the annular portion 30*a* of the upper heat transmission plate 18 defining thereinside the opening 30. As shown, annular portion 30*a* slightly protrudes from the flat section 22 of the heat transmission plate 18, so that the annular flange 32 fits inside the annular portion 30*a*.

The heat exchanger of this embodiment is assembled by piling up the heat transmission plates 18 in such a manner that the adjacent heat transmission plates 18, 18 are located peripherally shifted from each other by the angle of 90 degrees corresponding to the pitch P of the adjacent through-hole 28 and the opening 30 on the circle C on which the axis of each through-hole 28 and the opening 30 lie.

Figure 19:
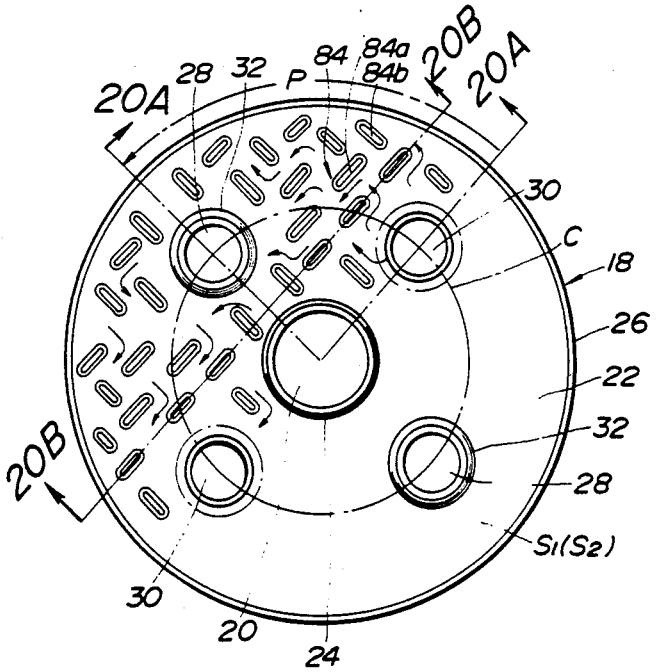
FIG. 19 is a plan view of a heat transmission plate forming part of a heat exchange element of a seventh embodiment of the heat exchanger according to the present invention.
Figure 20A:
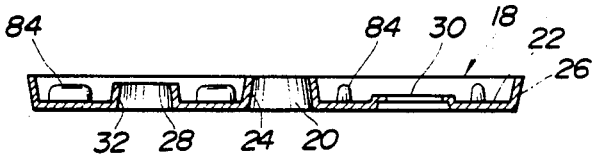
FIG. 20A is a sectional view taken in the direction of arrows substantially along the line 20A—20A of FIG. 19.
Figure 20B:
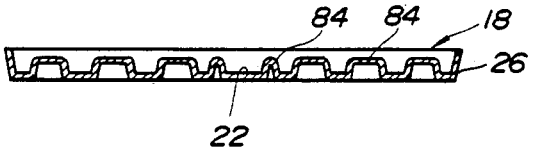
FIG. 20B is a sectional view taken in the direction of arrows substantially along line 20B—20B of FIG. 19.
Figure 21:
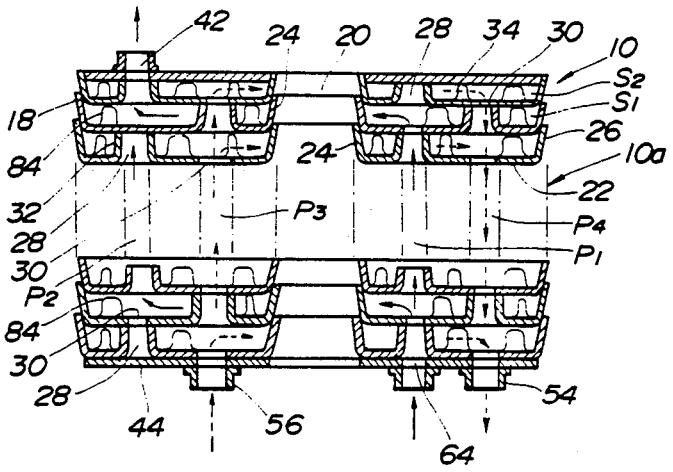
FIG. 21 is a vertical sectional view a heat exchange element of the seventh embodiment hea exchanger.

In this embodiment, each heat transmission plate 18 is formed with a plurality of elongate projections 84 which are located throughout whole the flat section 22 though only half the elongate projections are shown in FIG. 19 for the purpose of simplicity of illustration. Of the elongate projections 84, there are ones 84*a* whose longitudinal axis is parallel with an imaginary vertical plane containing the axes of the through-holes 28, and ones 84*b* whose longitudinal axis is parallel with an imaginary vertical plane containing the axes of the two openings 30, 30. Each projection 84*a* and each projection 84*b* may be integral with each other to form a T-shaped or L-shaped projection. As seen from FIG. 21, the elongate projections 84 of the lower one 18 of the adjacent heat transmission plates 18, 18 contact the surface of the upper one 18.

By virtue of the thus configurated heat transmission plates 18, the fluid entering the fluid flowing spaces $S_1$, $S_2$ from the opening 30 flows in a zigzag pattern along paths among the elongate projections 84 as shown in FIG. 19, so that the fluid can sufficiently reach the peripheral section of the fluid flowing space $S_1$ or $S_2$ defined between the adjacent heat transmission plates 18, 18. Furthermore, the elongate projections 84 of the lower heat transmission plate 18 contacts the surface of the upper heat transmission plate 18, thereby increasing the support strength between the adjacent heat transmission plates 18, 18. Thus, the seventh embodiment heat exchanger can be further improved in heat exchange efficiency and strength.

Figure 22:
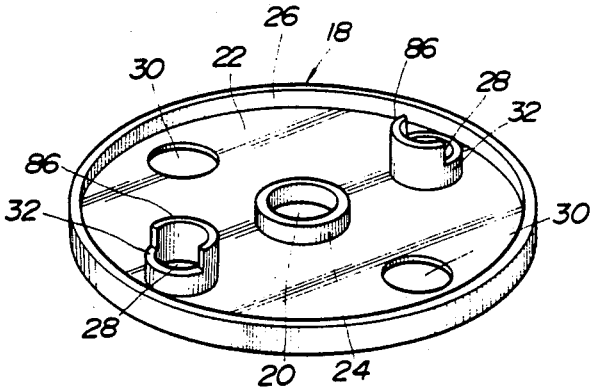
FIG. 22 is a perspective view of a heat transmission plate forming part of a heat exchanger element of the heat exchanger according to the present invention.
Figure 23:
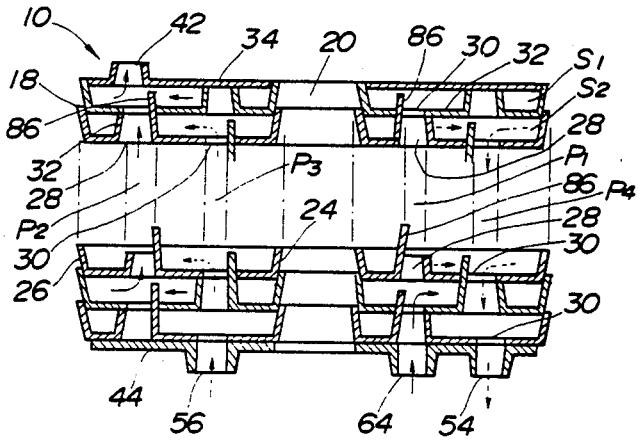
FIG. 23 is a vertical sectional view of the heat exchanger element of the eighth embodiment heat exchanger.
Figure 24:
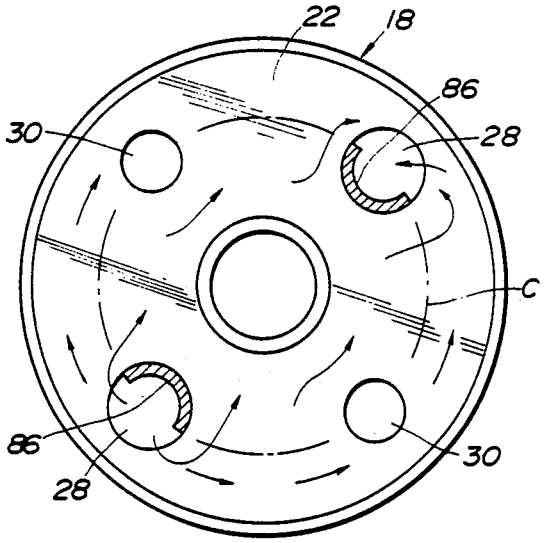
FIG. 24 is an illustration showing the flowing manner of fluid in the eighth embodiment heat exchanger.

FIGS. 22, 23 and 24 illustrate an eighth embodiment of the heat exchanger in accordance with the present invention, which is similar to the seventh embodiment heat exchanger with the exception that no elongate projection and no annular portion (defining the opening 30) are formed in each heat transmission plate 18. In this embodiment, each annular flange 32 is formed integrally with a generally semicylindrical baffle plate 86. In other words, the baffle plate 86 extends from the tip end portion of the annular flange 32 of the heat transmission plate 18. As shown, the peripheral length of the baffle plate 86 occupies about one half the periphery of the annular flange 32. The baffle plate 86 of one annular flange 32 is located on the side close to the other annular flange 32 so that the outer cylindrical surfaces of the baffle plates 86, 86 of the opposite annular flanges 32, 32 face to each other as clearly shown in FIGS. 22 and 24. It is to be noted that the length or height of the baffle plate 86 is slightly smaller than that of the annular flange 32.

The thus configurated heat transmission plates 18 are assembled to form the heat exchanger 10 as shown in FIG. 23 in which the baffle plate 86 of each annular flange 32 of the lower heat transmission plate 18 projects through the opening 30 into the fluid flowing space $S_1$, $S_2$ to approach the further upper heat transmission plate 18. However, the baffle plate 86 does not reach the above-mentioned further upper heat transmission plate 18. With the thus arranged heat exchanger 10, the fluid from the one opening 30 toward the other opening 30 is prevented from flowing along a short cut, so that the fluid flows upon being spreaded over the surface of the heat transmission plate flat section 22, thus improving heat exchange efficiency.

Figure 25:
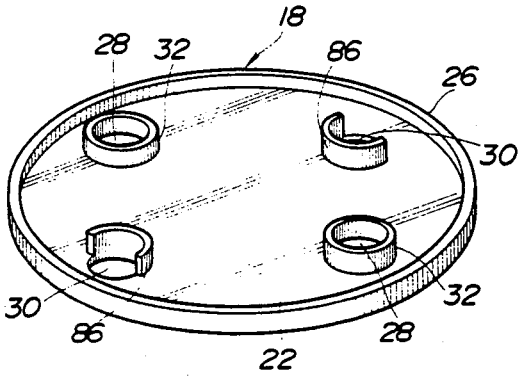
FIG. 25 is a perspective view of a heat transmission plate forming part of a heat exchanger element of a ninth embodiment of the heat exchanger according to the present invention.
Figure 26:
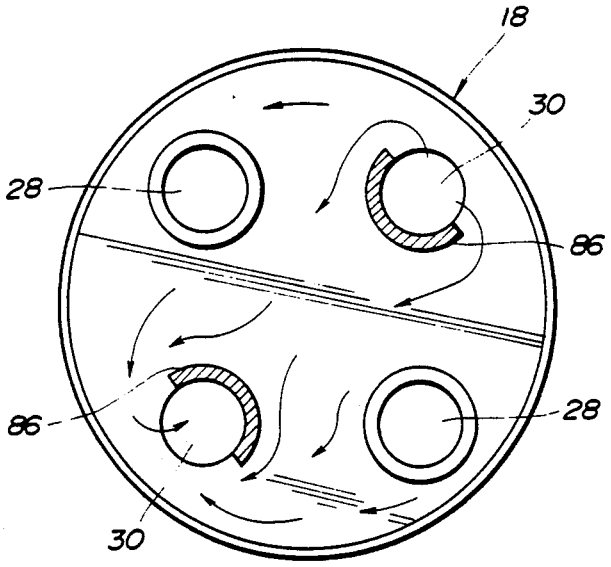
FIG. 26 is an illustration showing the flowing manner of fluid in the ninth embodiment heat exchanger.

FIGS. 25 and 26 illustrate a ninth embodiment of the heat exchanger according to the present invention, which is similar to eighth embodiment heat exchanger with the exception that no central hole is provided in each heat transmission plate 18. In this embodiment, the baffle plate 86 is formed along the periphery of each opening 30 in such a manner that the peripheral length of the baffle plate 86 occupies about one half the periphery of the opening 30. The baffle plate 86 is located along the periphery of the opening 30 on the side close to the other opening 30 so that the semicylindrical surfaces of the two baffle plates 86 face to each other. Accordingly, upon being assembled to the heat exchanger, fluid flows as indicated in FIG. 26 in which the fluid flow along the short cut can be effectively prevented to improve the heat exchange efficiency of the heat exchanger.

While engine lubricating oil and engine cooling water have been shown and described as two fluids between which heat exchange is required, it will be appreciated that the heat exchanger according to the present invention may be used for accomplishing heat exchange between two fluids other than the engine lubricating oil and the engine cooling water

What is claimed is:

1. A heat exchanger for first and second fluids, comprising:

a plurality of substantially identical heat transmission plates disposed one upon another, each heat transmission plate including a flat section through which heat exchange is made between the first and second fluids, a plurality of annular flanges formed extending from said flat section, each annular flange defining a through-hole opened through said flat section, and means for defining a plurality of openings opened through said flat section, at least one of said through-holes and at least one of said openings being alternately located along a circle on said flat section of said heat transmission plate, axes of adjacent said through-hole and said opening being separate from each other by a predetermined peripheral distance along said circle;

said heat transmission plates being located relative to one another such that a first one of adjacent heat transmission plates is shifted by said predetermined peripheral distance along said circle relative to the other of the adjacent heat transmission plates, in which said annular flange of said first heat transmission plate contacts said other heat transmission plate so that said through-hole of said first heat transmission plate communicates with said opening of said other heat transmission plate; and means for sealingly connecting said heat transmission plates to each other to define a first fluid flowing space for the first fluid and a second fluid flowing space for the second fluid on opposite sides of each of said first and other heat transmission plates.

2. A heat exchanger for first and second fluids, comprising:

a plurality of substantially identical heat transmission plates and disposed one upon another, each heat transmission plate including a flat section through which heat exchange is made between the first and second fluids, a plurality of annular flanges extending from said flat section, each annular flange defining a through-hole opened through said flat section, and means defining a plurality of openings opened through said flat section, an axis of at least one of said through-holes and an axis of at least one of said openings lying on a first circle on said flat section of said heat transmission plate, said at least one through-hole and said at least one opening being located along said first circle, the axes of adjacent said through-hole and said opening being peripherally separate from each other by a predetermined peripheral distance on said first circle , said plurality of heat transmission plates including first and second heat transmission plates which are located adjacent to and contacted with each other;

said heat transmission plates being located relative to one another such that said first heat transmission plate is peripherally shifted by said predetermined peripheral distance along said first circle relative to said second heat transmission plate, in which each annular flange of said first heat transmission plate contacts with said flat section of said section heat transmission plate so that said through-hole of said first heat transmission plate is aligned with said opening of said second heat transmission plate; and means for sealingly connecting said heat transmission plates to each other so that said first and second heat transmission plates are united to define a first fluid flowing space for the first fluid and a second fluid flowing space for the second fluid on opposite sides of said flat section of each of said first and second heat transmission plates.

3. A heat exchanger as claimed in claim 2, wherein said plurality of through-holes are an even number of through-holes, and said plurality of openings are an even number of openings.

4. A heat exchanger as claimed in claim 2, further comprising means for defining at least first, second, third, and fourth vertical fluid passages each of which includes vertically aligned said through-holes and said openings, said first and second vertical fluid passages communicating with said first fluid flowing space, said first and second vertical fluid passages communicating with inlet and outlet for the first fluid, respectively, said third and fourth vertical fluid passages communicating with said second fluid flowing space, said third and fourth vertical fluid passages communicating with inlet and outlet for the second fluid, respectively.

5. A heat exchanger as claimed in claim 2, wherein said plurality of through-holes are four through-holes, and said plurality of openings are four openings.

6. A heat exchanger as claimed in claim 3, wherein said plurality of through-holes are four through-holes, and said plurality of openings are four openings.

7. A heat exchanger as claimed in claim 3, wherein the axes of all said through-holes and said openings lie on said first circle.

8. A heat exchanger as claimed in claim 3, wherein the axis of at least one of said through-holes and at least one of said openings lie on said first circle, and the axis of at least one of said through-hole and opening lie on a second circle on said heat transmission plate flat section, said second circle being separate from and coaxial with said first circle.

9. A heat exchanger as claimed in claim 2, wherein each heat transmission plate is generally circular and includes an annular outer flange having inner and outer frustoconical surfaces, said outer flange and said annular flange mutually arranged so that when an upper portion of said annular flange contacts with said flat section of said second heat transmission plate, the inner frustoconical surface of said outer flange of said first heat transmission plate contacts with the outer frustoconical surface of said outer flange of said second heat transmission plate.

10. A heat exchanger as claimed in claim 9, wherein each heat transmission plate is generally annular and includes an annular inner flange having inner and outer frustoconical surfaces, said inner flange and said annular flange mutually arranged so that when an upper portion of said annular flange contacts with said flat section of said second heat transmission plate, the outer frustoconical surface of said inner flange of said first heat transmission plate contacts with the inner frustoconical surface of said inner flange of said second heat transmission plate.

11. A heat exchanger as claimed in claim 10, wherein said first heat transmission plate is located on said second heat transmission plate, in which said outer and inner flanges extend upward relative to a base member on which said heat exchanger is mounted, in which said annular flange defining said through-hole protrudes in the same direction as said outer and inner flanges extending.

12. A heat exchanger as claimed in claim 10, wherein said first heat transmission plate is located below said second heat transmission plate, in which said outer and inner flanges extend downward relative to a base member on which said heat exchanger is mounted, in which said annular flange protrudes in the same direction as said outer and inner flanges extending.

13. A heat exchanger as claimed in claim 2, wherein said heat transmission plate includes a plurality of projections extending from said flat section in the same direction as said annular flange.

14. A heat exchanger as claimed in claim 10, wherein said plurality of openings include two openings located close to each other, in which said heat transmission plate includes an elongate projection formed with said flat section and located between said two openings, said elongate projection being elongated in radial direction and extending in the same direction as said annular flange extends.

15. A heat exchanger as claimed in claim 2, wherein said heat transmission plate includes an annular short flange defining said opening, formed with said flat section and extending in opposite direction to said annular flange defining said through-hole, said annular short flange of said second heat transmission plate engaging with said annular flange of said first heat transmission plate.

16. A heat exchanger as claimed in claim 4, further comprising means defining a first fluid inlet chamber communicated with said first vertical fluid passage and with said first fluid inlet, a second fluid inlet chamber communicated with said third vertical fluid passage and with said second fluid inlet, and a second fluid outlet chamber communicated with said fourth vertical fluid passage and with said second fluid outlet.

17. A heat exchanger as claimed in claim 16, wherein said chambers defining means includes a first plate member secured to said heat transmission plate at lower-most position, and a second plate member disposed spaced from said first plate member, means forming a cylindrical outer wall surface to define a space between said first and second plate members, and a generally cylindrical wall member sealingly disposed between said first and second plate members and having first and second sections which are oppositely located, said first and second sections being in sealing contact with said cylindrical outer wall surface, in which said first fluid inlet chamber is defined inside said cylindrical wall member, and said second fluid inlet and outlet chambers are defined outside said cylindrical wall member on opposite sides of said cylindrical wall member.

18. A heat exchanger as claimed in claim 4, further comprising means defining a first fluid outlet chamber communicated with said second vertical fluid passage and with said first fluid outlet, a second fluid inlet chamber communicated with said third vertical fluid passage and with said second fluid inlet, and a second fluid outlet chamber communicated with said fourth vertical fluid passage and with said second fluid outlet.

19. A heat exchanger as claimed in claim 18, wherein said chambers defining means includes a third plate member secured, to said heat transmission plate at upper-most position, and a second plate member disposed spaced from said third plate member, means forming a cylindrical outer wall surface defining a space between said first and second plate member, and a generally cylindrical wall member sealingly disposed between said first and second plate members and having first and second sections which are oppositely located, said first and second sections being in sealing contact with said cylindrical outer wall surface, in which said first fluid outlet chamber is defined inside said cylindrical wall member, and said second fluid inlet and outlet chambers are defined outside said cylindrical wall member on opposite sides of said cylindrical wall member.

20. A heat exchanger as claimed in claim 12, wherein each heat transmission plate includes a plurality of elongate projections formed in said flat section and protruding in same direction as said annular flange, said plurality of elongate projections includes ones having a longitudinal axis parallel with a flat vertical plane, and ones having a longitudinal axis perpendicular to said vertical plane.

21. A heat exchanger as claimed in claim 20, wherein each elongate projection of said first heat transmission plate is in contact with said flat section of said second heat transmission plate.

22. A heat exchanger as claimed in claim 12, wherein said plurality of annular flanges include two annular flanges located opposite to each other with respect to axis of said heat transm,ission plate, in which each heat transmission plate includes first and second semicylindrical baffle plates, each baffle plate being integral with each annular flange and extending in direction far from the surface of said flat section, each baffle plate of said first heat transmission plate extends over said second heat transmission plate through said second heat transmission plate opening, said first and second baffle plates being so located that semicylindrical outer surfaces thereof face to each other.

23. A heat exchanger as claimed in claim 12, wherein said plurality of openings include two openings located opposite to each other with respect to axis of said heat transmission plate, in which each heat transmission plate includes first and second semicylindrical baffle plates, each baffle plate being integral with said flat section at semicircular section along periphery of each opening and extending in direction far from the surface of said flat section, said first and second baffle plates being so located that semicylindrical outer surfaces thereof face to each other.

24. A heat exchanger as claimed in claim 2, wherein said at least one through-hole and said at least one opening being alternately located along said first circle.

* * * * *